US008528640B2

(12) United States Patent
Agrawal

(10) Patent No.: US 8,528,640 B2
(45) Date of Patent: Sep. 10, 2013

(54) WELLBORE FLOW CONTROL DEVICES USING FILTER MEDIA CONTAINING PARTICULATE ADDITIVES IN A FOAM MATERIAL

(75) Inventor: Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 12/564,453

(22) Filed: Sep. 22, 2009

(65) Prior Publication Data

US 2011/0067872 A1 Mar. 24, 2011

(51) Int. Cl.
*E21B 43/04* (2006.01)

(52) U.S. Cl.
USPC ..... 166/276; 166/278; 166/228; 166/230

(58) Field of Classification Search
USPC ..... 166/278.228, 386, 369
See application file for complete search history.

(56) References Cited

U.S. PATENT DOCUMENTS

| | | | | |
|---|---|---|---|---|
| 3,878,686 | A * | 4/1975 | Hageman et al. | 405/264 |
| 5,618,853 | A | 4/1997 | Vonken et al. | |
| 5,664,628 | A | 9/1997 | Koehler et al. | |
| 7,048,048 | B2 * | 5/2006 | Nguyen et al. | 166/227 |
| 7,926,565 | B2 * | 4/2011 | Duan et al. | 166/278 |
| 2008/0087431 | A1 * | 4/2008 | Willauer et al. | 166/290 |
| 2008/0217002 | A1 * | 9/2008 | Simonds et al. | 166/230 |
| 2008/0264647 | A1 | 10/2008 | Li | |

OTHER PUBLICATIONS

International Search Report mailed Apr. 29, 2011, International Application No. PCT/US2010/094747.
Written Opinion of the International Searching Authority mailed Apr. 29, 2011; International Application No. PCT/US2010/049747.
Patents Act 1977: Examination Report under Section 18(3) dated Feb. 28, 2013 for Application No. GB1204017.6.

* cited by examiner

*Primary Examiner* — Zakiya W Bates
*Assistant Examiner* — Silvana Runyan
(74) *Attorney, Agent, or Firm* — Cantor Colburn LLP

(57) ABSTRACT

An embodiment of an apparatus may include a permeable member made by combining a particulate additive to one or more materials, which materials when processed without the particulate additive form a substantially impermeable mass, wherein the permeable member inhibits flow of solid particles above a particular size through the permeable member.

3 Claims, 4 Drawing Sheets

WELLBORE FLOW CONTROL DEVICES USING FILTER MEDIA CONTAINING PARTICULATE ADDITIVES IN A FOAM MATERIAL

BACKGROUND OF THE DISCLOSURE

1. Field of the Disclosure

The disclosure relates generally to apparatus and methods for controlling and filtering fluid flow into a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. The casing may include a filtering mechanism or device that removes contaminants from fluid which flows through the perforations. Filtering devices often have complex assembly structure and may require frequent maintenance and/or replacement due to clogging and breakdown of such devices due to the relatively harsh environment downhole. Servicing a downhole filter device may cause significant downtime for a wellbore, reducing productivity.

The present disclosure addresses at least some of these prior art needs.

SUMMARY OF THE DISCLOSURE

In aspects, the present disclosure provides an apparatus methods for controlling flow of formation fluids into a wellbore.

In one aspect a fluid flow device is provided that in one embodiment may include a substantially permeable member made by combining a particulate additive with one or more materials that when processed by themselves form a substantially impermeable mass.

In another aspect, a method for making a fluid communication device is provided that in one embodiment may include; providing one or more materials that when processed will provide a substantially non-permeable mass; providing a particulate additive; combining the particulate additive with the one or more materials to form a substantially permeable member. In another aspect, the method may further include placing the substantially permeable member adjacent a tubular member having fluid flow passages therein to form a screen that inhibits particles above a selected size in a fluid from flowing from the substantially permeable member into the tubular member.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters generally designate like or similar elements throughout the several figures of the drawing and wherein.

DETAILED DESCRIPTION OF THE EMBODIMENTS

Figure 1:
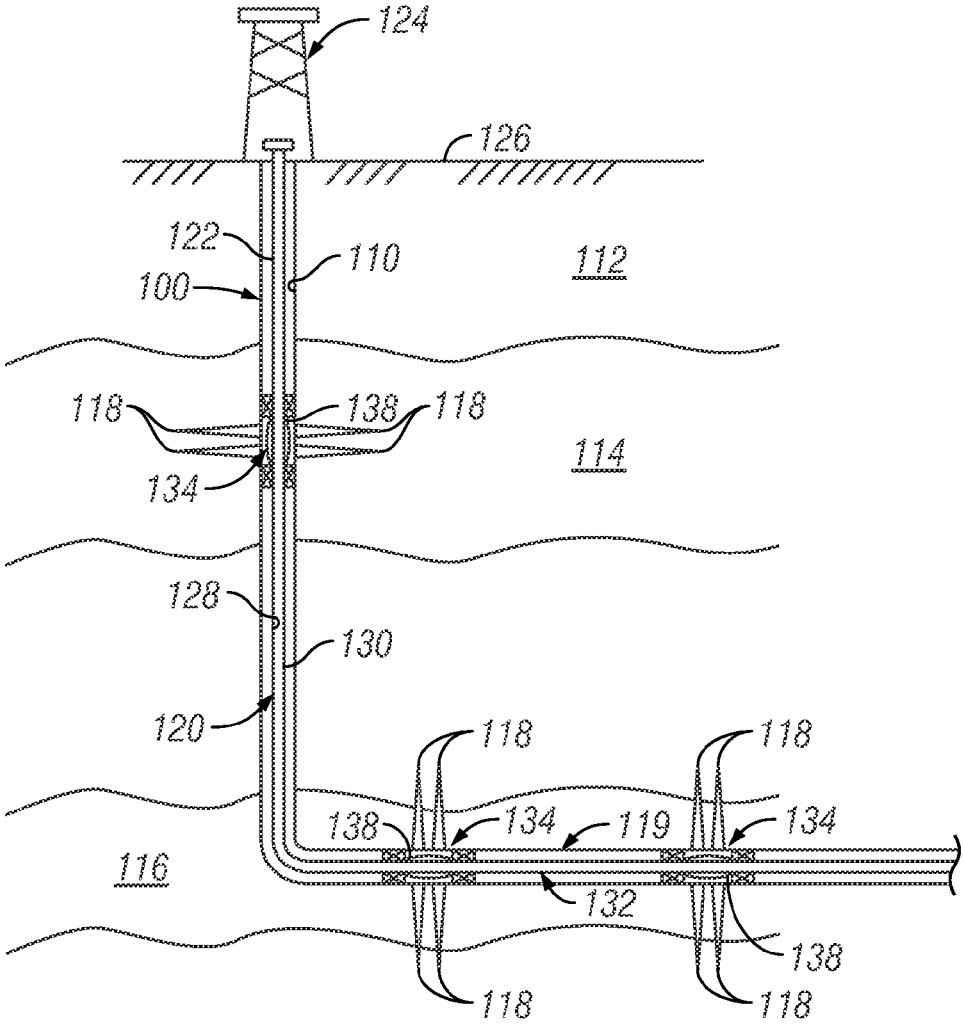
FIG. 1 is a schematic elevation view of an exemplary multi-zonal wellbore and production assembly which incorporates a fluid control system in accordance with one embodiment of the present disclosure.

The present disclosure relates to devices and methods for controlling fluid production at a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

FIG. 1 shows a side view of an exemplary wellbore 100 that has been drilled through the earth 112 and into a pair of formations 114 and 116 from which it is desired to produce hydrocarbons. The wellbore 110 is cased by metal casing, as is known in the art, and a number of perforations 118 penetrate and extend into the formations 114 and 116 so that production fluids may flow from the formations 114 and 116 into the wellbore 110. The wellbore 110 has a deviated, or substantially horizontal leg 119. The wellbore 10 has a late-stage production assembly, generally indicated at 120, disposed therein by a tubing string 122 that extends downwardly from a wellhead 124 at the surface 126 of the wellbore 100. The production assembly 120 defines an internal axial flowbore 128 along its length. An annulus 30 is defined between the production assembly 120 and the wellbore casing. The production assembly 120 has a deviated, generally horizontal portion 132 that extends along the leg 119 of the wellbore 100. Production devices 134 are positioned at selected locations along the production assembly 120. Optionally, each production device 134 may be isolated within the wellbore 100 by a pair of packer devices 136. Although only three production devices 134 are shown in FIG. 1, there may be a large number of such production devices arranged in a serial fashion along the horizontal portion 132.

Each production device 134 features a production control device 138 used to govern one or more aspects of flow of one or more fluids into the production assembly 120. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 138 may have a number of alternative constructions that ensure controlled fluid flow therethrough. In an aspect, the production devices 34 may be wellbore filtration devices, such as sand filtration screens. Further, the illustrated production devices 134 may utilize filtration media, materials, and bodies, as discussed with respect to FIGS. 2-8 of the present disclosure. As described herein, the devices discussed with respect to FIGS. 1-8 may be referred to as fluid control or fluid filtering devices.

Figure 2:
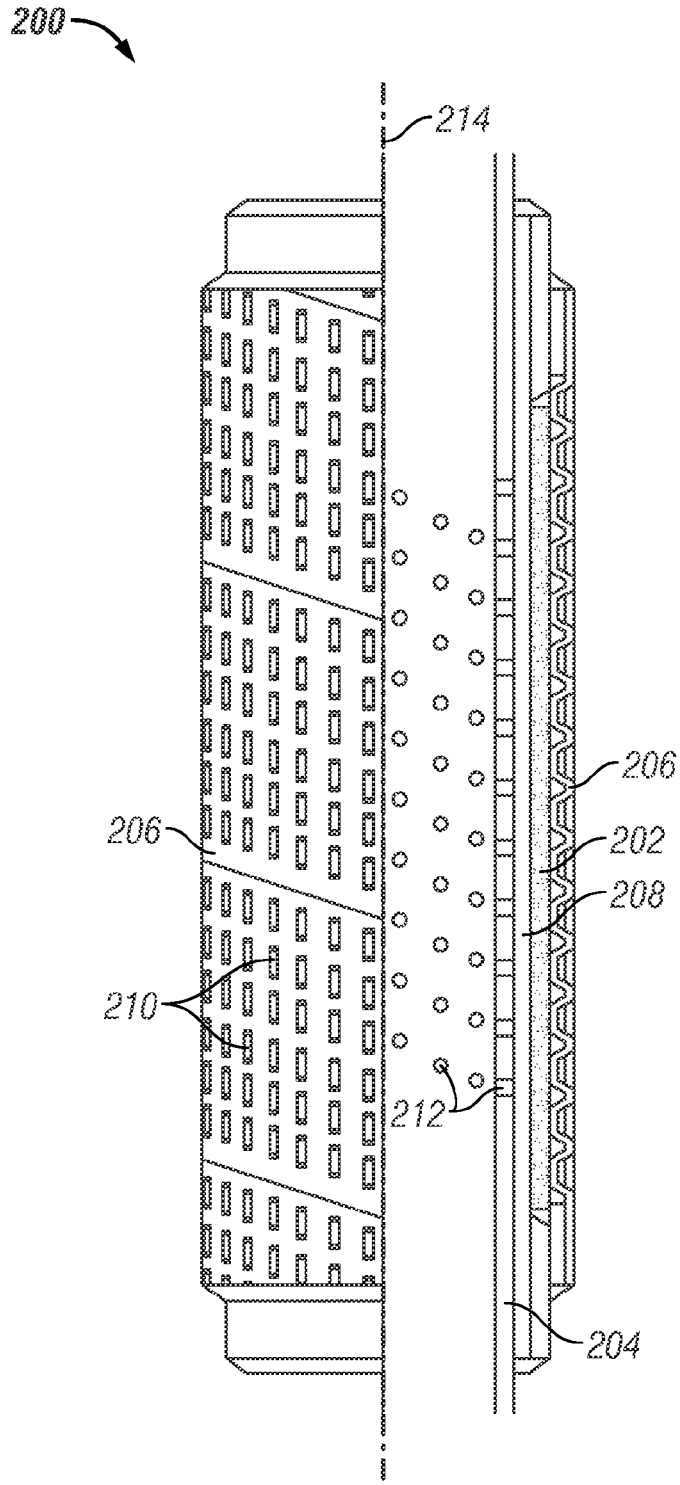
FIG. 2 is a sectional side view of an exemplary fluid flow device (or flow control device) that includes a filtration device in accordance with one embodiment of the present disclosure.

FIG. 2 is an illustration of an exemplary flow device 200 (also referred to as the "fluid flow device" or "production control" device) made according to one embodiment of the disclosure that may be placed in a wellbore. The flow device 200 is placed within a formation from which it is desired to produce hydrocarbons. The depicted flow device 200 is a side sectional view with a portion of the device structure removed to show the device's components. The wellbore is cased by metal casing and cement, and a number of perforations and flow passages enable production fluids to flow from the formation into the wellbore. The filtration device 200 may provide fluid communication paths and filtering mechanisms to remove unwanted solids and particulates from the production fluids. The depicted flow device 200 includes a filter member or body 202 which includes a substantially permeable foam mass configured to allow fluid flow into a tubing string, made according to one embodiment of the disclosure.

The exemplary flow device 200 also includes a tubular member 204, which provides a flow passage for the production fluid to the wellbore surface. In addition, a shroud member 206 may be positioned outside of the filter member 202. A standoff member 208 may be provided between the tubular member 204 and the filter body 202. The standoff member 208 may be arranged to provide structural support while also providing spacing between the filter body 202 and the tubular member 204, thereby reducing restrictions on the fluid flow into the tubular member 204. In some embodiments, the standoff member 208 may be referred to as a drainage assembly. The shroud member 206 may include passages 210, wherein the passages 210 may have tortuous fluid flow paths configured to remove larger particles from the production fluid prior to it entering the filtration device 200. Further, the shroud member 206 may provide protection from wear and tear on the filter member 202 and the flow device 200. The tubular member 204 includes passages 212 allow the production fluid to enter into the tubular member 204 and thus into the wellbore. In one aspect, the production fluid may flow along an axis 214, toward the surface of the wellbore. The filter member 202 may be formed from one or more materials or components, such as a polymeric foam, which create cells and cell walls in the body. The cell-based structure of the foam enables the filter body 202 to have a light weight and low density, reducing overall weight of the device while retaining a durable and effective fluid filter structure. For example, two chemical components or materials, which when or processed form a closed cell foam, may be used to form the foam mass. A closed cell foam is a foam with a cell structure that is substantially impermeable to fluid flow through the foam. Therefore, a foam mass composed of closed cell foam is substantially impermeable. As depicted, however, a particulate additive may be added to one or more of the components prior to formation of the foam mass to create fluid communication paths between closed cells and across the resulting mass or body. The additive causes formation of openings in the cell walls, therefore enabling passage of a fluid between the cells. Accordingly, the components that originally may be used to form a substantially non-permeable foam mass are altered by the addition of the particulate additive to form a substantially permeable member or foam mass. In an embodiment, the filter member 202 may be formed by any suitable polymeric material, such as polyurethane, epoxy, fluorinated polymer and other polymers and their blends.

As discussed below, the flow device 200 may have a number of alternative constructions that ensure controlled fluid flow therethrough. Various materials may be used to construct the components of the filtration device 200, including metal alloys, steel, polymers, any suitable durable and strong material, or any combination thereof. As depicted herein, the illustrations shown in the figures are not to scale, and assemblies or individual components may vary in size and/or shape depending on desired filtering, flow, or other relevant characteristics. Further, some illustrations may not include certain components removed to improve clarity and detail of the elements being discussed.

Figure 3:
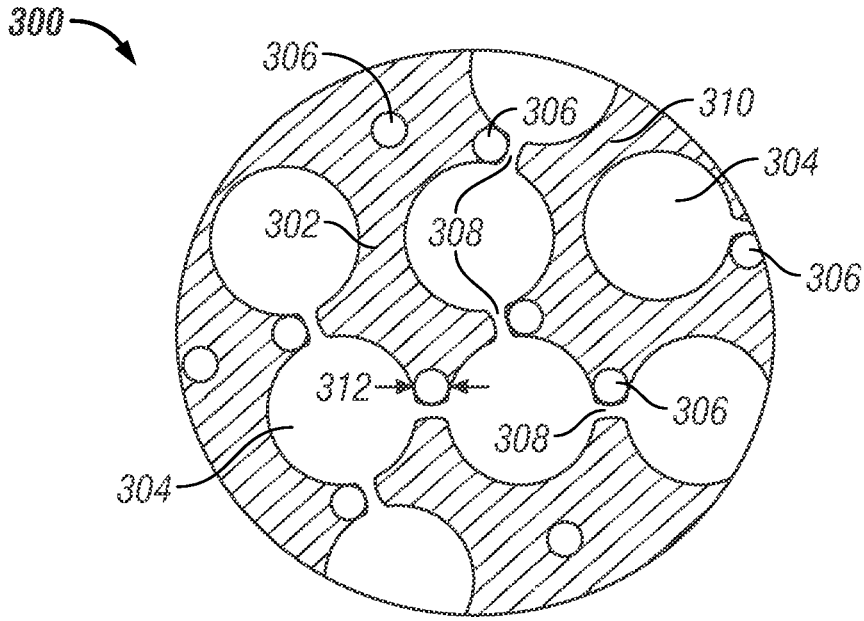
FIG. 3 is a view of an exemplary foam mass including cells and cell walls in accordance with one embodiment of the present disclosure.

FIG. 3 is a view of a portion of an exemplary permeable foam mass 300, which is formed into a body of the filtration device. The illustration provides a magnified view of a foam structure, and the foam's cell structure. A polymeric foam may be mixed to form the permeable foam mass 300. The permeable foam mass 300 may include cell walls 302 which form cells 304 that are open spaces filled with a gas or other fluid. For a permeable foam mass, the ratio of open cell (304) volume to cell wall (302) volume may vary, depending on the materials used and the desired filter properties such as permeability, weight, and durability. For example, the open cell to cell wall volume ratio may range from 8:1 to 1:1.

The components or materials used to form the permeable foam mass may be mixed with a particulate additive 306, which creates fluid communication paths or openings 308. The particulate additive 306 may be composed of any suitable inert material, including clay, mica, fine sand, salt dust, ground mineral dust, silica, carbonate, titania, glass fibers, carbon fibers, polymer fibers, polymer fibers, or ceramic fibers. In addition, nano-particles may be used as an additive, including, but not limited to, buckey balls, carbon nano tubes, or graphene platelets. The size and concentration of the particulate additive 306 may depend on the components used to form the cell structures as well as the ratio of open cells to cell walls. Other factors, including application specific needs, such as tensile strength requirements, size of particles to be filtered from the production fluid, and desired permeability of the body, may also influence the size and amount of particulate additives. In one embodiment, approximately 0.05% to 3% by weight of polymeric solids of a particulate additive may be added to the mixture of foam components. For example, about 1.5 grams of a particulate additive may be added during a mixing of a polymer, wherein the total weight of the polymeric solid is about 100 grams when dry. Therefore, the particulate additive is about 1.5% by weight of the solid polymer material. In addition, the particulate additive 306 may be approximately 0.01 to 0.5 millimeters in size or diameter.

During formation of the cell walls 302 and cells 304, the particulate additive 306 may occupy cell wall regions, wherein the particulate additive 306 may cause a fracture in the cell wall to enable formation of the openings 308. Not all cell walls are occupied and/or fractured by the particulate additives 306. The lack of particulate induced fracture is illustrated by a solid wall 310. In such a case, the solid wall 310 provides strength for the cell structure of the permeable foam mass 300. In one aspect, a wall thickness 312 may be substantially the same dimension as the particulate additive 306 diameter, enabling formation of the openings 308. For example, the particulate additive 306 may be added to one or more foam mass components prior to mixing to form a foam mass. After mixing the components, the particulate additives 306 may cause openings to form in cell walls during cooling of the foam. Accordingly, the openings 308 enable fluid communication between cells of the mass. The openings may be formed during the mixing and formation of the foam mass or via a mechanical process, such as compression and expansion or forcing a fluid through the cells within the mass. The foam mass 300 created by this process may be described as substantially permeable, wherein the cell wall formations and fractures enable a selected amount of fluid to flow therethrough. Moreover, the structure provided by the cells and cell walls enables the foam mass 300 to retain desirable characteristics of a closed cell foam, such as compressive strength, rigidity, and durability, while also exhibiting the permeable characteristics of an open cell foam. Although the description provided above relates to two components that form an impermeable member and one particulate additive, one or more than one particulate additives may be combined with one or more or other materials to produce the filtration member or mass according to this disclosure. Further, in an aspect, the permeable member is a mass having an open volume to a solid volume ratio of about 4 to 1. In such a case, the open volume is a cavity that enables fluid flow and the solid volume is a foam or other structure that inhibits fluid flow. Moreover, after addition of the particulate additive, the permeable member is a mass having a mechanical strength that is up to about 20% less than the mechanical strength of the substantially impermeable mass prior to addition of the particles.

Figure 4:
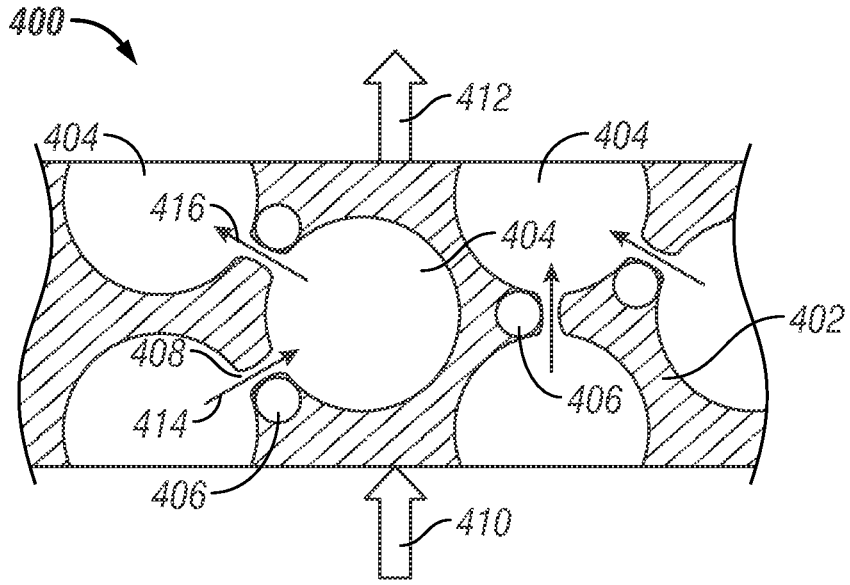
FIG. 4 is a view of an exemplary body formed from a foam mass including fluid communication paths within the body in accordance with one embodiment of the present disclosure.

Referring to FIG. 4, the illustration provides a view of an exemplary body 400 of a permeable foam mass. In an aspect, the body 400 may be a sheet or layer that is wrapped around a tubular fluid communication structure. Cell walls 402 form a structure around cells 404, which may be filled with fluids, such as gases or liquids that travel through the body 400. The cell walls 402 may be formed by a chemical reaction between two or more components, thereby forming the cells 404, which are open areas or regions filled with a gas, and the cell wall 402 structures. As depicted, a particulate additive 406 may be added to the components to cause formation of passages 408 to enable fluid communication between cells 404 and across the body 400. The particulate additive 406 may be a plurality of granulate inert structures that range in size, causing fractures in the cell walls 402 during formation. For example, a fluid 410 may enter one side of the body 400, travel through the passages 408, and exit the body, as shown by arrow 412. Accordingly, during a fluid filtering operation, a fluid may travel as shown by arrows 414 and 416 through the body 400.

Figure 5:
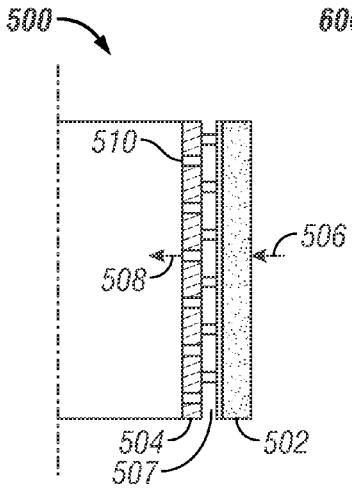
FIG. 5 is a sectional side view of an exemplary filtration device including a standoff member and a body formed from a foam mass in accordance with one embodiment of the present disclosure.

FIG. 5 is a sectional side view of an exemplary filtration device (or filtration member) 500, which may be used in a wellbore as illustrated in FIGS. 1 and 2, To enhance clarity, the illustration includes only one half of the filtration device 500. The filtration device 500 includes a filter member or filter body 502 formed from a permeable foam mass as described previously. The filtration device 500 may also include a tubular member or pipe 504, which directs the production fluid to the wellbore surface. The fluid may flow from a formation, as shown by an arrow 506, into the filter body 502. The filter body 502 may be coupled to a standoff member 507, which enables drainage and flow of the fluid between the filter body 502 and the tubular member 504. The production fluid may flow 508 into the pipe 504 via passages 510. In an embodiment, the filtration device 500 is a sand screen assembly used to remove solids and contaminants from production fluid prior to extraction.

Figure 6:
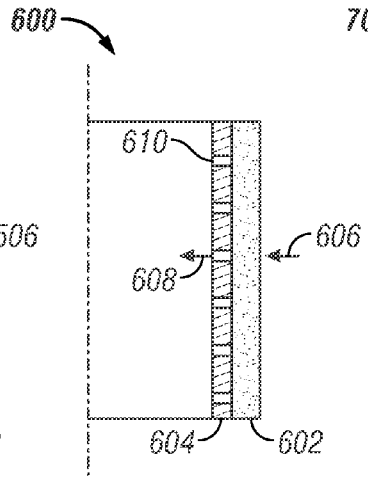
FIG. 6 is a sectional side view of an exemplary filtration device including a body formed from a foam mass, where the body is located outside a tubular structure, in accordance with one embodiment of the present disclosure.

FIG. 6 is a sectional side view of another exemplary filtration device 600, as discussed with respect to FIG. 5. The illustration includes only one half of the filtration device 600 to enhance clarity. The filtration device 600 includes a filter body 602, which is formed from a permeable foam mass. The filtration device 600 also includes a pipe 604, which directs the production fluid to the wellbore surface. As depicted, the filter body 600 is a sheet or layer wrapped around the pipe 604. The fluid may flow, as shown by an arrow 606, into the filter body 602. In addition, the production fluid may flow 608 into the pipe 604 via passages 610. The filter body 602 may include components that are sufficiently rigid and strong to withstand direct impingement from large particles in the formation fluid.

Figure 7:
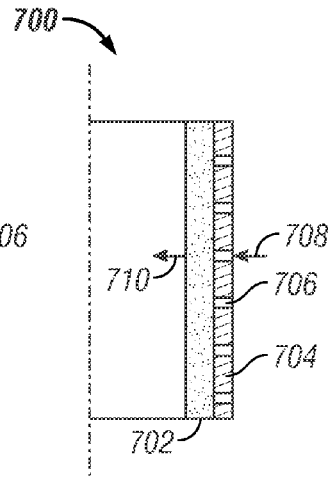
FIG. 7 is a sectional side view of an exemplary filtration device including a body formed from a foam mass, where the body is located inside a tubular structure, in accordance with one embodiment of the present disclosure.

FIG. 7 is a sectional side view of another exemplary filtration device 700, as previously discussed with respect to FIGS. 5 and 6. The illustration includes only one half of the filtration device 700 to enhance clarity. The filtration device 700 includes a filter body 702, which is formed from a permeable foam mass. The filtration device 700 also includes a pipe 704, wherein the filter body 702 is located inside the pipe 704. The production fluid may flow through pipe passages 706, as shown by an arrow 708, into the filter body 702. The permeable mass within the body 702 enables fluid flow while filtering the fluid prior to flowing inside the body, as shown by an arrow 710, prior to flowing axially to the surface. As depicted, the filter body 700 is a sheet or layer of permeable foam mass placed within the pipe 704.

As discussed herein, the permeable foam mass may include a shape-conforming material. The types of materials that may be suitable for preparing the shape-conforming material may include any material that is able to withstand typical downhole conditions without undesired degradation. In non-limiting embodiments, such material may be prepared from a thermoplastic or thermoset medium. This medium may contain a number of additives and/or other formulation components that alter or modify the properties of the resulting shape-conforming material. For example, in some non-limiting embodiments the shape-conforming material may be either thermoplastic or thermoset in nature, and may be selected from a group consisting of polyurethanes, polystyrenes, polyethylenes, epoxies, rubbers, fluoroelastomers, nitriles, ethylene propylene diene monomers (EPDM), other polymers, combinations thereof, and the like.

In certain non-limiting embodiments the shape-conforming material may have a "shape memory" property. Therefore, the shape-conforming material may also be referred to as a shape memory material or component. As used herein, the term "shape memory" refers to the capacity of the material to be heated above the material's glass transition temperature, and then be compressed and cooled to a lower temperature while still retaining its compressed state. However, it may then be returned to its original shape and size, i.e., its pre-compressed state, by reheating close to or above its glass transition temperature. This subgroup, which may include certain syntactic and conventional foams, may be formulated to achieve a desired glass transition temperature for a given application. For instance, a foaming medium may be formulated to have a transition temperature just slightly below the anticipated downhole temperature at the depth at which it will be used, and the material then may be blown as a conventional foam or used as the matrix of a syntactic foam.

The initial (as-formed) shape of the shape-conforming material may vary, though an essentially cylindrical shape is usually well-suited to downhole wellbore deployment, as discussed herein. The shape-conforming material may also take the shape of a sheet or layer, as a component of a fluid or sand control apparatus. Concave ends, striated areas, etc., may also be included in the design to facilitate deployment, or to enhance the filtration characteristics of the layer, in cases where it is to serve a sand control purpose.

Figure 8:
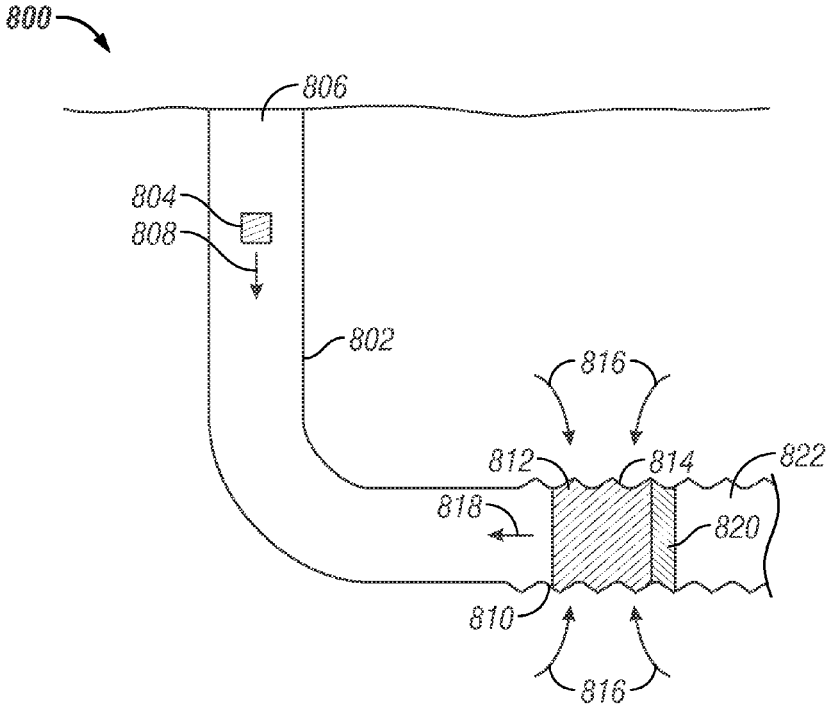
FIG. 8 is a schematic view of an exemplary wellbore and fluid flow control plugs as a part of a production assembly in accordance with one embodiment of the present disclosure.

Referring to FIG. 8, the illustration shows an exemplary wellbore 800 where a plug composed of permeable foam mass may be utilized as part of a fluid production assembly. The schematic illustration has several elements of a production assembly removed to enhance clarity of the elements to be discussed. The wellbore 800 may be drilled through the earth to form a borehole including an upper region 802, where a compacted plug 804 may be deployed. As depicted, the compacted plug 804 travels from a wellbore surface 806 downhole 808 to a selected location 810 within the wellbore. The compacted plug 804 is formed from a shape memory foam, which may be formed into the plug shape below a glass transition temperature of the shape-memory foam. The shape memory foam also includes the particulate additive, as described above, which cause the foam to be substantially permeable while also exhibiting shape memory characteristics. The compacted plug 804 may retain its compact shape while the plug is below the glass transition temperature. Once the plug reaches the selected location 810 downhole, exposure to a temperature at or above the glass transition temperature causes an expanded plug 812 to conform to formation walls 814. Accordingly, formation fluid flow 816 is drawn to and through the permeable foam mass of the expanded plug 812. The fluid then flows from the plug 812 toward the wellbore surface 806, as shown by an arrow 818. The expanded plug 812 may include or be coupled to a substantially non-permeable member 820, thereby prevent fluid flow in a downhole region 822. The substantially non-permeable member 820 may be a closed cell foam or other material with shape-memory properties as discussed above. The shape of the compacted (804) and expanded (812) plugs may be configured to adapt to the wellbore. For example, a cylindrical wellbore may require cylindrical plugs 804 and 812.

When shape-memory foam is used as a filtration device or media for downhole sand control applications, it is preferred that the filtration device remains in a compressed state during run-in until it reaches to the desired downhole location. Usually, downhole tools traveling from surface to the desired downhole location take hours or days. When the temperature is high enough during run-in, the heat might be sufficient to trigger expansion of the filtration devices made from the shape-memory polyurethane foam. To avoid undesired early expansion during run-in, delaying methods may or must be taking into consideration. In one specific, but non-limiting embodiment, poly(vinyl alcohol) (PVA) film is used to wrap or cover the outside surface of filtration devices made from shape-memory polyurethane foam to prevent expansion during run-in. Once filtration devices are in place in downhole for a given amount of time at given temperature, the PVA film is capable of being dissolved in the water, emulsions or other downhole fluids and, after such exposure, the shape-memory filtration devices can expand and totally conform to the bore hole. In another alternate, but non-restrictive specific embodiment, the filtration devices made from the shape-memory polyurethane foam may be coated with a thermally fluid-degradable rigid plastic such as polyester polyurethane plastic and polyester plastic. The term "thermally fluid-degradable plastic" is meant to describe any rigid solid polymer film, coating or covering that is degradable when it is subjected to a fluid, e.g. water or hydrocarbon or combination thereof and heat. The covering is formulated to be degradable within a particular temperature range to meet the required application or downhole temperature at the required period of time (e.g. hours or days) during run-in. The thickness of delay covering and the type of degradable plastics may be selected to be able to keep filtration devices of shape-memory polyurethane foam from expansion during run-in. Once the filtration device is in place downhole for a given amount of time at temperature, these degradable plastics decompose allowing the filtration devices to expand to the inner wall of bore hole. In other words, the covering that inhibits or prevents the shape-memory porous material from returning to its expanded position or being prematurely deployed may be removed by dissolving, e.g. in an aqueous or hydrocarbon fluid, or by thermal degradation or hydrolysis, with or without the application of heat, in another non-limiting example, destruction of the cross-links between polymer chains of the material that makes up the covering.

As shown in the upper region 802, the shape-memory material has the compressed, run-in, compacted plug 804 form factor. After a sufficient amount heating at or above the glass transition temperature, the shape-memory permeable plug 804 expands from the run-in or compacted position to the expanded or set form 812 having an expanded thickness. In so doing, the shape-memory material of the expanded plug 812 engages with the formation walls 814, and, thus, prevents the production of undesirable solids from the formation, allows only hydrocarbon fluids flow through the expanded plug 812.

Further, when it is described herein that the filtration device 804 or plugs 812 "conforms" to the wellbore or "plugs" the wellbore, what is meant is that the shape-memory porous material expands or deploys to fill the available space up to the wellbore wall. The wellbore wall will limit the final, expanded shape of the shape-memory porous material and thus may not permit it to expand to its original, expanded position or shape. In this way however, the expanded or deployed shape-memory material as a component of the plug (804 and 812), being porous, remain in its plugged position in the wellbore and thus will permit hydrocarbons to flow from a subterranean formation into the wellbore, but will prevent or inhibit solids of particular sizes from entering the wellbore. This is because solids larger than certain sizes will generally be too large to pass through the open cells of the porous material. The type, amount and sizes of the additive particulates may be chosen to determine the size of the particles that will be inhibited from passing through the open cell porous material.

While the foregoing disclosure is directed to certain disclosed embodiments and methods, various modifications will be apparent to those skilled in the art. It is intended that all modifications that fall within the scopes of the claims relating to this disclosure be deemed as part of the foregoing disclosure. The abstract provided herein is to conform to certain regulations and it should not be used to limit the scope of the disclosure herein or any corresponding claims.

What is claimed is:

1. A method of producing fluid from a formation surrounding a well bore, comprising:

providing a fluid flow device that includes a permeable member made by combining a particulate additive to one or more materials, which materials when processed without the particulate additive produce a closed cell mass, wherein the particulate additive occupies walls of the one or more materials to form openings in the walls, the openings in the walls providing permeability for the permeable member wherein the permeable member inhibits flow of solid particles above a particular size through the permeable member; placing the fluid flow device at a selected location in the wellbore; and allowing the fluid from the formation to flow through the fluid flow device, wherein the permeable member inhibits flow of solid particles above a particular size through the permeable member.

2. The method of claim 1, wherein the fluid flow device further includes a tubular member having fluid flow passages therein inside the permeable member and a protective member outside the permeable member.

3. The method of claim 1, wherein the permeable member includes a shape memory mass and placing the fluid flow device at the selected location in the wellbore comprises:

heating the permeable member to attain a first expanded shape;

compressing the permeable member to second contracted shape;

cooling the permeable member to attain the second contracted shape;

placing the fluid flow device into the wellbore while the permeable member is in the second contracted shape; and allowing the permeable member to heat to expand to plug a portion of the wellbore inside.

* * * * *